US012722068B2

(12) United States Patent
Ceolin

(10) Patent No.: US 12,722,068 B2
(45) Date of Patent: Sep. 1, 2026

(54) GUARD ASSEMBLY FOR PROTECTING PARTS OF A PERSON'S BODY AND METHOD OF USE THEREOF

(71) Applicant: Viktor Sebastian Ceolin, Toronto (CA)

(72) Inventor: Viktor Sebastian Ceolin, Toronto (CA)

( * ) Notice: Subject to any disclaimer, the term of this patent is extended or adjusted under 35 U.S.C. 154(b) by 17 days.

(21) Appl. No.: 18/663,622

(22) Filed: May 14, 2024

(65) Prior Publication Data

US 2024/0382820 A1 Nov. 21, 2024

Related U.S. Application Data

(60) Provisional application No. 63/502,220, filed on May 15, 2023.

(51) Int. Cl.
*A63B 71/12* (2006.01)

(52) U.S. Cl.
CPC .. *A63B 71/1225* (2013.01); *A63B 2071/1258* (2013.01)

(58) Field of Classification Search
CPC ..... A63B 71/1225; A63B 22/0285; A63B 71/1258; A41D 31/04
See application file for complete search history.

(56) References Cited

U.S. PATENT DOCUMENTS 2,553,612 A 5/1951 Taylor
4,484,360 A 11/1984 Leighton et al.
5,405,312 A 4/1995 Jacobs
6,032,286 A 3/2000 Thomas et al.
6,654,961 B2 12/2003 Bèland
D505,753 S 5/2005 Qvortrup
D553,302 S 10/2007 Wiens
D555,291 S 11/2007 Danzo
8,777,191 B2 7/2014 Kligerman et al.
10,159,295 B2 * 12/2018 Frey ..... A42B 3/065
(Continued)

FOREIGN PATENT DOCUMENTS

DE 3225355 A1 1/1984
DE 20016219 U1 12/2000
(Continued)

*Primary Examiner* — Alissa L Hoey
*Assistant Examiner* — Akwokwo Olabisi Redhead
(74) *Attorney, Agent, or Firm* — Sand, Sebolt & Wernow Co., LPA

(57) ABSTRACT

A guard assembly for protecting part of a person's body from impact injury or stud injury. The guard assembly includes a rigid shield and a liner selectively detachably engaged with one another. The shield is fabricated from recycled post-consumer plastics. The liner may be fabricated from a shock absorbing material, particularly a sustainable material. The liner is placed against the person's skin and the shield overlays the liner. Protrusions extending from an outer surface of the liner are received through complementary holes defined in the shield, thus interlockingly engaging the shield and liner with one another. The protrusions extend for a distance outwardly beyond the shield's outer surface. When the guard assembly is used as a shin guard assembly, the protrusions will contact the inner surface of a sock, sleeve, or athletic tape and aid in frictionally retaining the shin guard assembly and sock, sleeve or athletic tape in place.

17 Claims, 10 Drawing Sheets

(56) References Cited

U.S. PATENT DOCUMENTS

| | | | | |
|---|---|---|---|---|
| 2006/0085884 | A1* | 4/2006 | Giacheri | A63B 71/1225 2/24 |
| 2007/0294799 | A1 | 12/2007 | Pedigo et al. | |
| 2010/0129573 | A1* | 5/2010 | Kim | B32B 3/08 156/263 |
| 2012/0180183 | A1 | 7/2012 | Mechling et al. | |
| 2012/0240303 | A1 | 9/2012 | Matta et al. | |
| 2012/0260392 | A1* | 10/2012 | Votel | A41D 13/065 2/24 |
| 2013/0167282 | A1* | 7/2013 | Ramirez | A41D 13/087 2/21 |
| 2013/0232674 | A1* | 9/2013 | Behrend | A41D 13/0543 2/455 |
| 2013/0234376 | A1* | 9/2013 | Frey | A41D 13/015 267/141 |
| 2018/0318693 | A1* | 11/2018 | Corrigan | A41D 13/0506 |
| 2022/0095712 | A1 | 3/2022 | Nylund | |
| 2024/0081434 | A1* | 3/2024 | Leslie | A41D 13/00 |
| 2025/0040634 | A1* | 2/2025 | Arslan | A63B 71/1225 |

FOREIGN PATENT DOCUMENTS

| | | | |
|---|---|---|---|
| KR | 200302759 | Y1 | 1/2003 |
| KR | 200395557 | Y1 | 9/2005 |
| WO | 2022187425 | A1 | 9/2022 |

* cited by examiner

GUARD ASSEMBLY FOR PROTECTING PARTS OF A PERSON'S BODY AND METHOD OF USE THEREOF

REFERENCE TO RELATED APPLICATIONS

This application claims the benefit of U.S. Provisional Patent Application Ser. No. 63/502,220 filed May 15, 2023, the entire disclosure of which is incorporated herein by reference.

TECHNICAL FIELD

This disclosure is directed to equipment for protecting the human body. In particular, the disclosure is directed to protective athletic equipment. Specifically, the disclosure is directed to a guard assembly capable of protecting a part of a person's body from impact type injuries. The guard assembly includes a rigid shield and a liner which is selectively detachably engageable with the shield. The liner is fabricated from a shock-absorbing material which preferably is a sustainable material which is able to be recycled after being disengaged from the shield. The rigid shield is fabricated from post-consumer plastics and overlays the liner when seated on the person's skin. Protrusions extending outwardly from an outer face of the liner are received in complementary holes defined in the shield and engagement of the protrusions in the holes retains the liner and shield in interlocking engagement with one another. In one embodiment, the sports guard assembly is a shin sports guard assembly for protecting an athlete's shins.

BACKGROUND ART

Athletes of contact sports such soccer, football, and hockey are prone to being injured when other players contact their lower legs during play of the game. In particular, the athletes are at risk of suffering blunt force impact and stud impact to their shins as other players attempt to kick a soccer ball, for example, or play a slap shot with a hockey stick. When another player kicks a ball or swings their hockey stick, their foot, or stick can inflict blunt force impact on the shins of another player and possibly break a bone, or cause bruising of the soft tissues of the lower leg.

In order to protect shins from impact injury or stud injury, athletes wear shin guards to place a physical barrier between their shins and potential agents of injury. Shin guards are fabricated to absorb and dissipate the energy from blunt force and stud impact and thereby aid in reducing injuries to the shins.

Currently, a number of companies produce shin guards, but all of these companies fabricate similar shin guards from similar materials. Shin guards currently on the market have a plastic front shell which is provided to protect the athlete's shins against blunt force impact. The shin guards typically have a polyurethane foam backing engaged with the shell. The polyurethane foam backing contacts the user's skin and provides cushioning against impact. A chemical adhesive is used to permanently join the plastic front shell and the foam backing to one another.

While presently known shin guards do protect an athlete's shins from injury, it is common for the foam backing to collect sweat and dirt during use. The shin guards therefore steadily degrade over time and become foul smelling. When this occurs, athletes tend to throw their shin guards away. In many sports, such as soccer, shin guards are mandatory for all athletes regardless of their age or ability. A typical youth soccer player will have two training sessions and one game per week and may also play soccer for two seasons a year. This schedule can result in the player throwing one or two shin guards away each year because their shin guards are foul smelling and degraded. The number of discarded shin guards is exacerbated because many athletes, like soccer players, tend to start playing their sport when young. They will therefore throw out additional shin guards simply because they have grown out of a particular size of shin guard.

Regardless of the reason, when presently available shin guards are thrown away, they end up in landfills and this is bad for the environment. In 2014, Greenpeace Germany found toxic chemicals in all soccer products including shoes, balls, gloves, and shin guards. Some shin guards have been found to include a high level of Perfluorinated Compounds (PFCs). Some PFCs are particularly bad for the environment because they do not break down and tend to build up in wildlife.

SUMMARY OF THE INVENTION

The present disclosure is directed to athletic equipment for protecting a part of a person's body from impact injury. The disclosed sports guard assembly includes a rigid shield, preferably fabricated from post-consumer plastics, and a separate liner configured to be positioned between the rigid shield and the person's body. The shield is sufficiently rigid and hard enough to withstand most impacts experienced during play of a contact-type sport or during typical working conditions in which protective equipment is required. The separate liner is able to be selectively engaged with the shield for use of the sports guard assembly but is detachable therefrom after use. The liner preferably is fabricated from a sustainable material, i.e., a material that is renewable, durable, non-toxic to the environment, and recyclable after use. The liner serves at least three purposes. The liner provides comfortable cushioning between the person's body and the hard shield. The liner is able to absorb some moisture, such as perspiration, and thereby wick moisture away from the person's skin. Finally, the liner is configured in such a way as to increase friction between the sports guard assembly and the athlete's clothing, such as between a sports guard assembly for a shin and a sock that is worn over the sports guard assembly. The configuration of the disclosed sports guard assembly helps to retain the device in place on the person's body. Because the liner is able to be disengaged from the shield, there is opportunity for the liner to dry out after use and therefore less tendency for the liner to degrade and become foul-smelling. The ability to disengage the liner also allows for the opportunity to clean both components to increase their longevity. The liner is able to be used a number of times before being thrown away or recycled. The liner is also able to be replaced when it becomes worn or damaged and this ensures that the shield is able to be used for a longer period of time than if the liner was permanently secured to the shield.

In one aspect, an exemplary embodiment of the present disclosure may provide a guard assembly for protecting a part of a person's body comprising a shield; a liner; wherein the liner is selectively detachably engaged with the shield; and wherein the liner is fabricated from a sustainable and recyclable material.

In one embodiment, the guard assembly may further comprise a plurality of holes defined in one of the shield and the liner; a plurality of protrusions defined in the other of the shield and the liner; and wherein each protrusion of the plurality of protrusions is receivable through an associated hole of the plurality of holes. In one embodiment, the plurality of protrusions received through the plurality of holes may interlockingly engage the shield and liner with one another. In one embodiment, the one or more protrusions of the plurality of protrusions may be of a size substantially equal to a size of one or more holes of the plurality of holes. In one embodiment, the plurality of holes may be defined in the shield and each hole of the plurality of holes extends from an outer surface of the shield to an inner surface of the shield. In one embodiment, the liner may contact the inner surface of the shield and the plurality of protrusions may extend through the plurality of holes of the shield. In one embodiment, the plurality of protrusions may project for a distance beyond the outer surface of the shield. In one embodiment, the shield may be fabricated from recycled post-consumer plastics. In one embodiment, the shield is fabricated from a rigid material and the liner is fabricated from a shock absorbing material. In one embodiment, the guard assembly is a sports guard assembly, the shield is reusable for one or more sports seasons and the liner is replaceable after less than one sports season.

In one aspect, an exemplary embodiment of the present disclosure may provide a guard assembly for protecting a part of a person's body, said guard assembly comprising a shield formed from a material capable of withstanding blunt force impact and/or stud impact; at least one hole defined in the shield, wherein the at least one hole extends between an outer surface and an inner surface of the shield; a liner formed from a shock absorbing material; at least one protrusion extending outwardly from an outer surface of the liner; wherein the at least one protrusion of the liner is received through the at least one hole in the shield when the outer surface of the liner is brought into abutting contact with the inner surface of the shield; and wherein engagement of the at least one protrusion in the at least one hole retains the liner and shield in interlocking engagement with one another.

In one embodiment, the at least one protrusion may be of a size relative to the at least one hole that when the at least one protrusion is received in the at least one hole, relative movement between the shield and the liner is substantially prevented or limited. In one embodiment, the liner may be fabricated from a sustainable/recyclable material. In one embodiment, the shield may be fabricated from recycled post-consumer plastics. In one embodiment, a sports guard assembly kit may be provided which comprises the guard assembly as described in the previous paragraph, wherein the guard assembly comprises a single shield and a plurality of liners that are interchangeably engageable with the single shield.

In one aspect, an exemplary embodiment of the present disclosure may provide a liner for a sports guard assembly comprising a body having an outer surface and an opposed inner surface, wherein the outer surface is adapted to be complementary in configuration to an inner surface of a shield of the sports guard assembly; a plurality of protrusions provided on the outer surface of the body; wherein the plurality of protrusions extend for a distance outwardly beyond the outer surface; and wherein the plurality of protrusions are configured to be complementary in shape, size and arrangement to a plurality of holes defined in the shield. In one embodiment, the body may be molded from a shock absorbing material that is fully recyclable. Preferably, the recyclable material is a sustainable material.

In one aspect, an exemplary embodiment of the present disclosure may provide a method of protecting a part of a person's body from impact comprising providing a guard assembly comprising a liner and a shield; extending one or more protrusions on an outer surface of the liner through one or more holes defined in the shield; interlockingly engaging the liner and shield to one another via the one or more protrusions and the one or more holes; placing an inner surface of the liner in abutting contact with the person's body; wherein the shield overlays the liner and an outer surface of the shield comprises a first point of contact with the guard assembly in an impact.

In one embodiment, the part of the person's body being protected with the guard assembly is the person's shin; and wherein the method further comprises placing the outer surface of the shield in abutting contact with an inside of a sock, a sleeve or athletic tape extending over/or around the person's shin; and frictionally engaging the guard assembly with the sock or the sleeve or the athletic tape through contact of the one or more protrusions of the liner with the inside of the sock or the sleeve or the athletic tape. In one embodiment, the method may further comprise disengaging the liner from the shield when the liner becomes worn, damaged or emits a foul odor; cleaning, recycling or disposing of the liner once disengaged from the shield; engaging a replacement liner with the shield by extending one or more protrusions on the replacement liner through the one or more holes defined in the shield; and interlockingly engaging the replacement liner and shield to one another via the one or more protrusions extending through the one or more holes.

In one embodiment, the shield may be fabricated from recycled post-consumer plastics. In one embodiment, the liner may be fabricated from any material but preferably one that is sustainable. The material may also be a recycled material such as a recycled paper product. In one embodiment, the shield and liner may frictionally engage one another. In one embodiment the shield and liner may engage one another in such a manner that lateral, longitudinal, and/or diagonal movement of the shield and liner relative to one another is substantially limited. In one embodiment the sports guard assembly may further comprise one or more holes defined in the shield, wherein the one or more holes extend between an inner surface and an outer surface of the shield; and one or more protrusions extending outwardly from an outer surface of the liner; wherein the one or more protrusions are arranged to be received through the one or more holes when the liner is engaged with the shield. In one embodiment, the one or more protrusions may extend outwardly from the outer surface of the liner for a distance which is greater than a thickness of the shield, wherein the thickness of the shield is measured between the outer surface and inner surface of the shield.

In another aspect, an exemplary embodiment of the present disclosure may provide a sports guard assembly kit comprising a shield formed of a rigid material capable of withstanding blunt force impact from a fall or from a kick or a strike from a bat or ball or stud impact from athletic footwear; and a plurality of liners which are frictionally detachably engageable with the shield.

In one embodiment, each liner of the plurality of liners may be fabricated from recycled paper products and may be fully recyclable after disengagement from the shield.

In another aspect, and exemplary embodiment of the present disclosure may provide a liner for a sports guard assembly comprising a body formed to be complementary to an inner surface of a rigid shield of the sports guard assembly; wherein the body is molded from a recycled paper product; and wherein the body is recyclable after disengagement from the shield.

In one embodiment, the body may include an inner surface configured to conform to a shin of an athlete, and an outer surface opposed to the inner surface; and the body may further comprise one or more protrusions which extend outwardly for a distance beyond the outer surface of the body. In one embodiment, the protrusions may be arranged in a pattern complementary to a pattern of holes defined in the shield, and wherein the protrusions are configured to extend through the holes in the shield in order to detachably secure the liner to the shield.

In another aspect, and exemplary embodiment of the present disclosure may provide a method of protecting a player's shin from blunt force impact and stud impact comprising providing a shin guard comprising a liner molded from paper products and a rigid shield; extending one or more protrusions on the liner through one or more complementary holes defined in the rigid shield; placing an inner surface of the liner in abutting contact with the player's shin; placing an outer surface of the rigid shield in abutting contact with an inside of a sock or sleeve extending over the player's shin; and frictionally engaging the shin guard with the sock or sleeve through contact of the one or more protrusions of the liner with the inside of the sock or sleeve.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Referring to FIGS. 1-7, there is shown a shin sports guard assembly in accordance with the present disclosure, generally indicated at 10. Sports guard assembly 10 may also be referred to herein as "assembly 10". Assembly 10 comprises an outer shield 12 and a liner 14 which are selectively detachably engageable with one another. The configuration, selective engagement, and use of shield 10 and liner 14 will be discussed later herein in greater detail.

Figure 1:
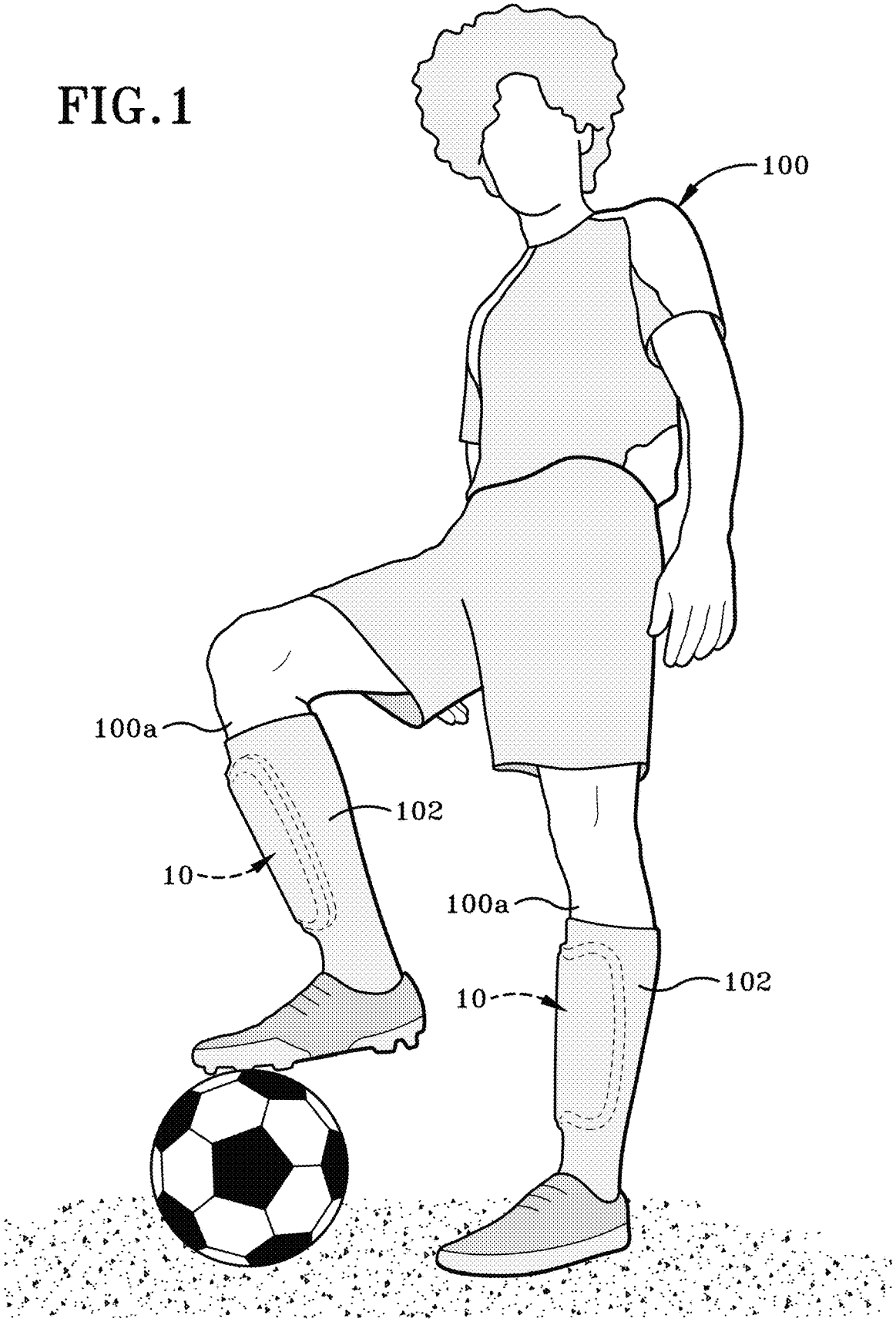
FIG. 1 is front, bottom, right side perspective view of a soccer player using a shin sports guard assembly in accordance with the present disclosure to protect each of their shins.
Figure 2:
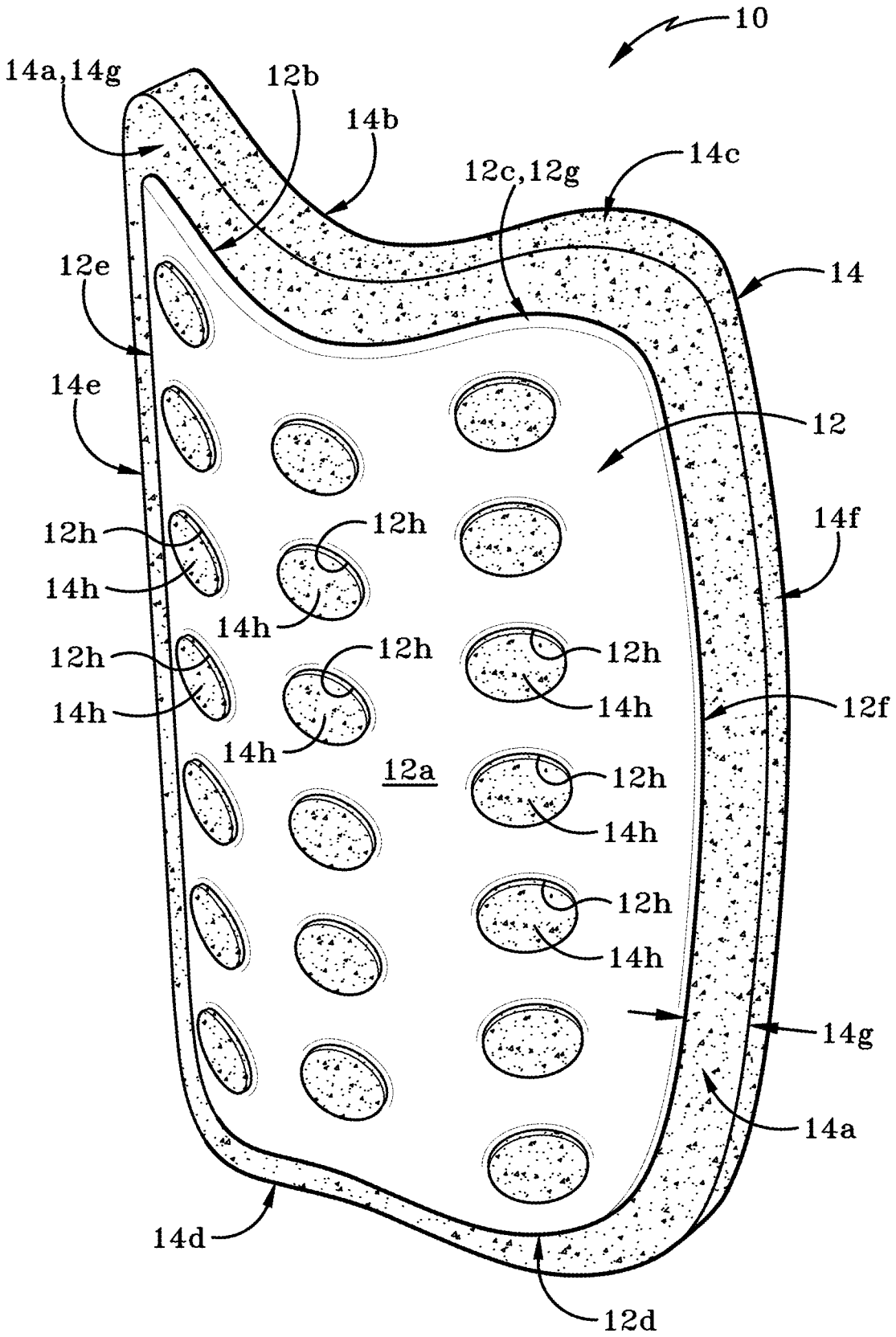
FIG. 2 is a front, top, right side perspective view of the shin sports guard assembly in accordance with the present disclosure shown in isolation and in an assembled condition.

FIG. 1 shows a soccer player 100 utilizing assembly 10 to protect the player's shins 100*a*. Assembly 10 is illustrated as being a "slip in" style shin guard. This type of shin guard is positioned against the player's shin 100*a* and a sock or sleeve 102 is pulled over at least a part of the shin guard to retain the same in contact with the player's shin 100*a*. Although not illustrated in FIG. 1 it will be understood that in other embodiments, Pre-Wrap or another similar sports tape may be utilized to hold assembly 10 against the player's shin 100*a*. The player's socks 102 may then be pulled up over both the Pre-Wrap and the assembly 10 to further hold the assembly 10 in contact with the player's shin 100*a*.

Soccer player 100 as illustrated in FIG. 1 is exemplary of any athlete or worker who will benefit from wearing assembly 10. It will be understood that assembly 10 may be used to protect athletes and players other than soccer players from injury to their shins. Hockey players, football players, and rugby players, for example, may utilize assembly 10. Assembly 10 may also be used by any worker or other person who wears protective devices in the performance of their work or play.

Referring now to FIGS. 2-7, shield 12 of sports guard assembly 10 will be described in greater detail. Shield 12 comprises a relatively hard, strong, and rigid component configured to be able to withstand impact. Shield is formed to be arcuate in cross-section (FIG. 4) and is shaped in this manner so as to generally conform to the shape of a human shin 100*a* (FIG. 1). Shield 12 is fabricated from materials which are specifically selected to provide sufficient strength and rigidity to shield 12 so that assembly 10 will be able to withstand the types of impacts experienced during play of a sport. Suitable materials for fabrication of shield 12 include recycled post-consumer plastics. Using post-consumer plastics for shield 12 is not only good for production of shield 12 itself but is also good for the environment by providing a market for recycled plastics.

Post-consumer plastics suitable for use in production of shield 12 include, but are not limited to, polypropylene ("PP"), polyethylene ("PE"), KEVLAR® and K-RESIN®. (KEVLAR® is a registered trademark of Dupont Safety & Construction, Inc. of Wilmington Delaware, U.S. and K-RESIN® is a registered trademark of Phillips Petroleum Company of Bartlesville Oklahoma, U.S.). In one preferred embodiment, shield 12 is molded from K-RESIN®.

While the shield 12 has been disclosed above as preferably being fabricated from post-consumer plastics, it should be understood that shield 12 may be fabricated from suitable plastic materials which are recyclable or are made from recycled materials or from partially recycled or partially recyclable materials, or even from non-recyclable or non-recycled materials.

Shield 12 is fabricated to be durable and is therefore able to be used repeatedly for a long period of time. Preferably shield 12 will be capable of being usable for at least one or more seasons of a sport. Shield 12 may be fabricated in any desired color or color pattern so as to give assembly 10 an aesthetically pleasing appearance. Preferably, color is imparted to the post-consumer plastics used in shield 12 in a manner that is not detrimental to the natural environment.

Figure 3:
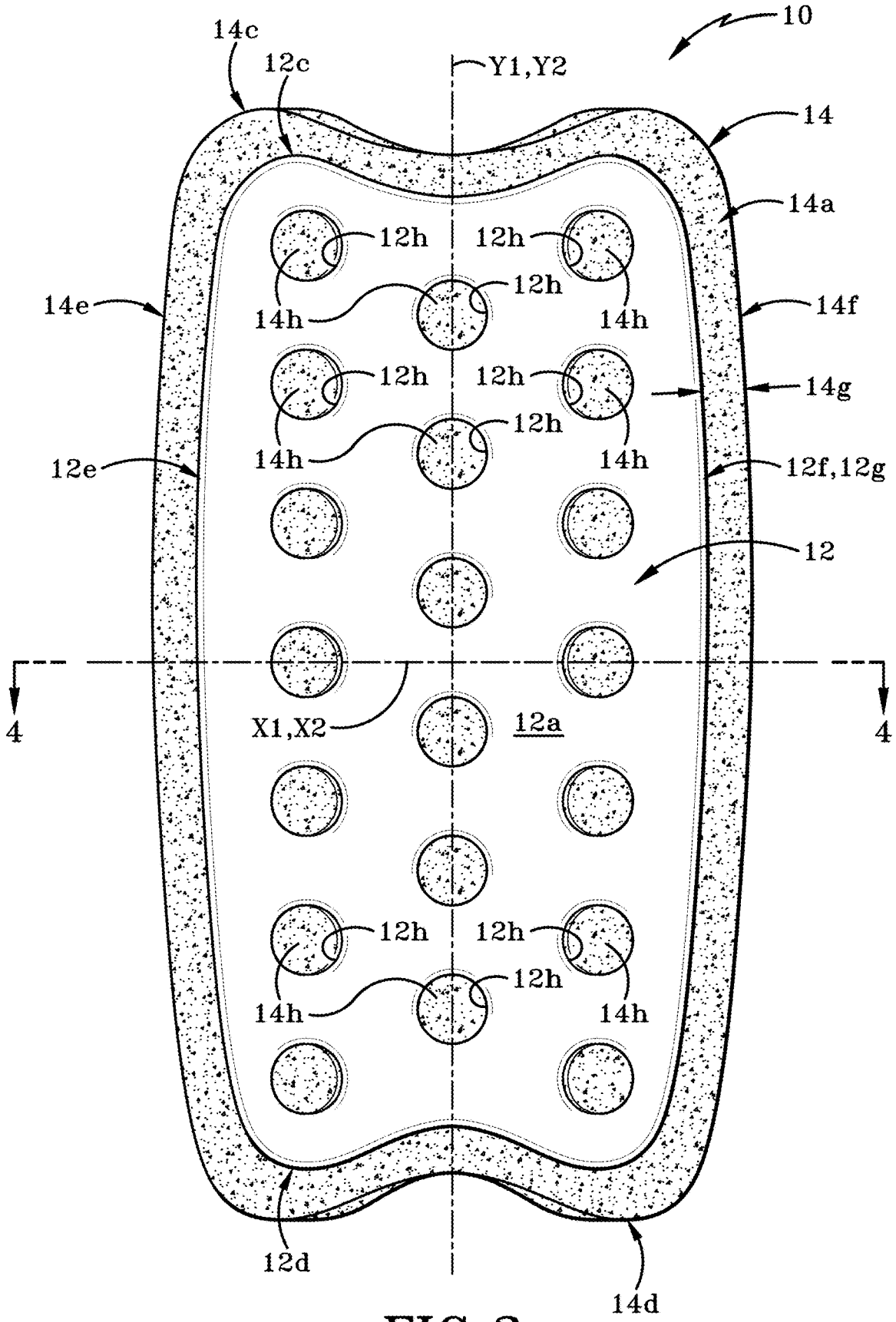
FIG. 3 is a front elevation view of the shin sports guard assembly of FIG. 2.
Figure 4:
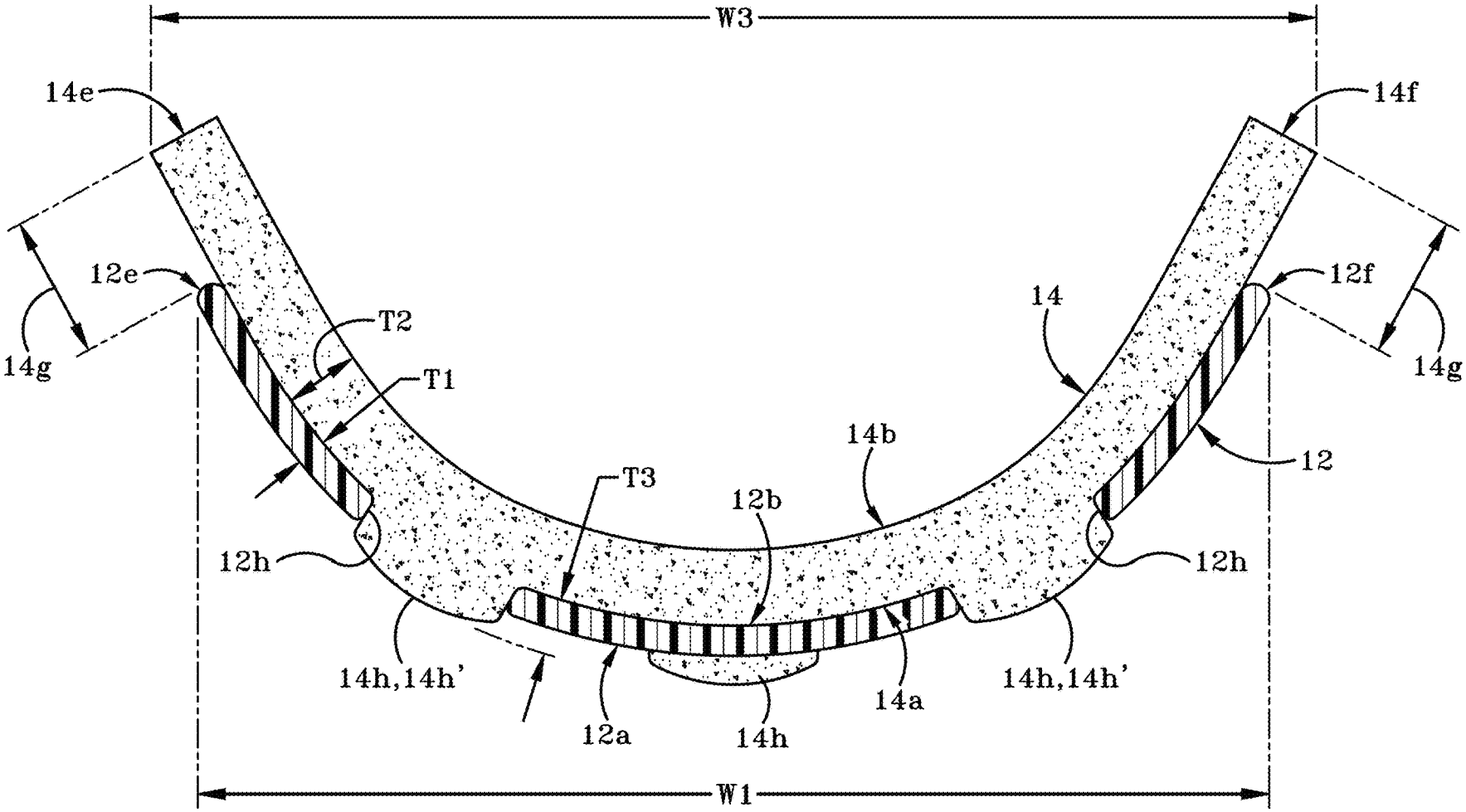
FIG. 4 is a cross-section of the shin sports guard assembly looking in the direction of line 4-4 of FIG. 3.

The configuration of shield 12 is best seen in FIGS. 2-4, 5A and 5B. Shield 12 comprises a body having an outer surface 12*a* and an inner surface 12*b* located opposite one another; a first end 12*c* and a second end 12*d* located opposite one another; and a first side 12*e* and a second side 12*f* located opposite one another. The body of shield 12 is generally arcuate in cross-section as best seen in FIG. 4. In particular, inner surface 12*b* of body 12 is concave in configuration and outer surface 12*a* is convex in configuration. Inner surface 12*b* is configured to conform, at least generally, to the shape of an exterior of the player's shin 100*a*.

The body of shield 12 is shown in FIG. 3 as having an imaginary centerline "Y1" which extends between a central region of first end 12*c* and a central region of second end 12*d*. As is evident from FIG. 3, the body of shield 12 is symmetrical about centerline "Y1". Shield 12 is also shown as having an imaginary midline "X1" measured between first end 12*e* and second end 12*f* and extending from first side 12*e* to second side 12*f*. The imaginary midline "X1" is orthogonal to the imaginary centerline "Y1". As is evident from FIG. 3, the body of shield 12 is also symmetrical about midline "X1". The symmetrical shape of shield 12 ultimately provides improved coverage of the player's shin and is an efficient shape for production of the shield 12.

It will be noted from FIG. 3 that each of first end 12*c* and second end 12*d* of shield 12 is generally U-shaped. In particular, first end 12*c* is U-shaped and second end 12*d* is an inverted U-shape. As a result of this arrangement, shield 12 is of a height "H1" measured along centerline "Y1" and between first end 12*c* and second end 12*d*. Height "H1" is smaller than the height "H2" of shield 12 measured between those portions of first end 12*c* and second end 12*d* which are at the greatest distance apart from one another, measured along a line parallel to centerline "Y1". The U-shaped configuration of first end 12*c* and second end 12*d* of shield 12 is provided so that the shin sports guard assembly 10 has less of a tendency to interfere with the player's kneecap or ankle during use. It will be understood, however, that any other suitable configuration of first end 12*c* and second end 12*d* may be provided on shield 12 without departing from the scope of the present disclosure.

Shield 12 is of a maximum width "W1" measured between first side 12*e* and second side 12*f* and along midline "X1". FIG. 3 shows that shield 12 is widest at midline "X1" and tapers gradually in width moving away from midline "X1" in a first direction towards first end 12*c*. Shield 12 also tapers gradually in width moving away from midline "X1" in a second direction towards second end 12*d*. The body of shield 12 is of a smallest width "W2" proximate each of the first end 12*c* and the second end 12*d*. The upper and lower corners of the shield's body, where first end 12*c* and second end 12*d* join first side 12*e* and second side 12*f*, are gently rounded. This arrangement ensures that shield 12 does not present any sharp corners and edges which might injure the player 100 (FIG. 1). The body of shield 12 has a thickness "T1" (FIG. 4) measured between outer surface 12*a* and inner surface 12*b* thereof. In one embodiment, the thickness "T1" may be between 1.5 mm and 2 mm. It should also be noted from FIG. 4 that the first side 12*e* and second side 12*f* have a gently convexly curved profile, i.e., are rounded, so as to ensure the sides 12*e*, 12*f* do not present sharp edges that could injure the player. The first and second ends 12*c*, 12*d* are similarly gently convexly curved or rounded in profile. The shield 12 therefore has an exterior perimeter, generally indicated at 12*g* (FIG. 6A), which is designed to be both aesthetically pleasing and less prone to inadvertently injuring the player when assembly 10 is impacted during play. The exterior perimeter 12*g* is comprised of the first end 12*c*, first side 12*e*, second end 12*d*, and second side 12*f*.

Figure 6A:
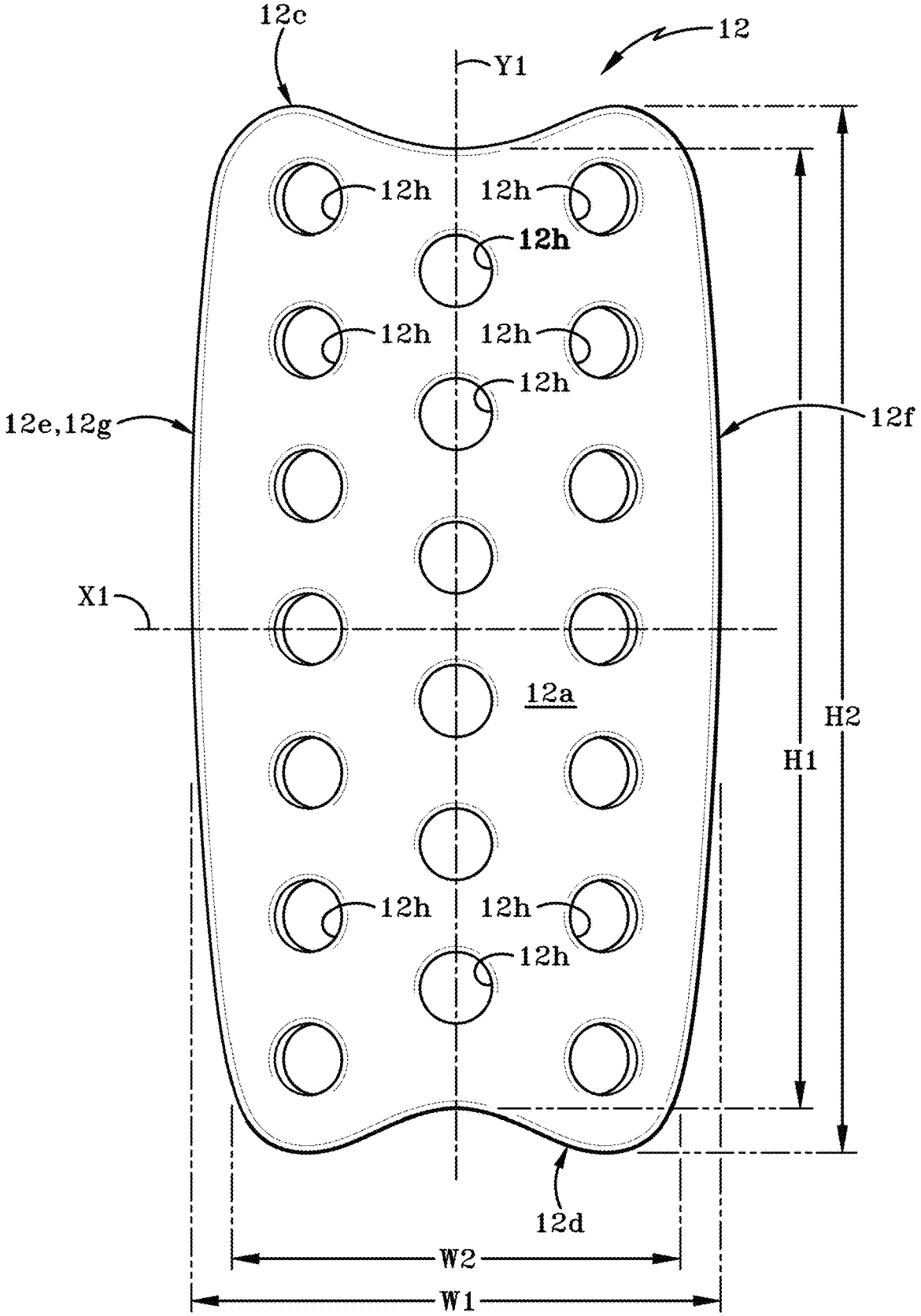
FIG. 6A is a front, top, right side perspective view of the outer shield of the shin sports guard assembly of FIG. 2 shown in isolation.
Figure 6B:
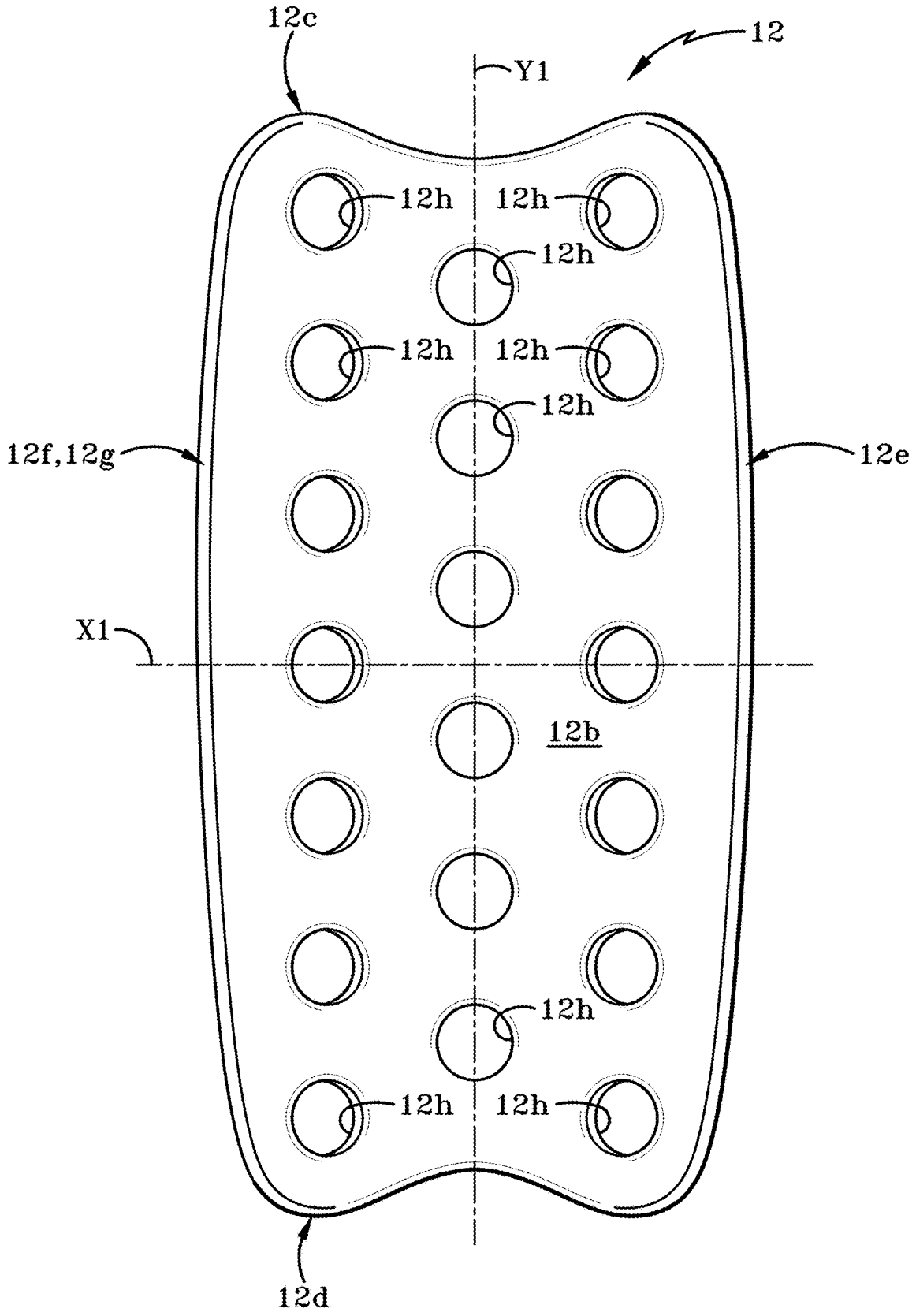
FIG. 6B is a rear elevation view of the outer shield shown in FIG. 6A.

In accordance with an aspect of the present disclosure, a plurality of holes 12*h* (FIG. 6A) is defined in shield 12. Each hole 12*h* extends from outer surface 12*a* through to inner surface 12*b* of shield 12. FIG. 6A illustrates holes 12*h* as all being circular in shape. It will be understood that in other embodiments the holes defined in shield 12 may be of any desired shape other than circular without departing from the scope of the present disclosure. For example, the holes may all be square, rectangular, oval, elliptical, triangular, or of an irregular shape. In other embodiments, the holes may comprise elongate rectangular slots or curved or arcuate slots. In yet other embodiments, the holes defined in shield 12 may be configured in more than one shape. For example, some of the holes may be circular while others are square and/or triangular. Any desired shape or combination of shapes of the holes defined in shield 12 are contemplated to fall within the scope of the present disclosure.

FIG. 6A further illustrates that all holes 12*h* in shield are not only of the same shape but are also of a substantially identical size. In other words, all holes 12*h* which are circular in shape are of an identical diameter. It will be understood that in other embodiments, shield 12 may define a plurality of holes that are of the same shape but different dimensions without departing from the scope of the present disclosure. Shield 12 may therefore define a plurality of circular holes but some of the holes will be of a larger diameter than others of the holes.

In yet other embodiments, shield 12 may define holes that are not only of different shapes relative to one another but are also of different dimensions. For example, some of the holes may be circular in shape and of a first size while others of the holes may be square or triangular and either smaller or larger in size than the diameter of the circular holes.

FIG. 6A further illustrates that holes 12*h* are arranged in a pattern on shield 12. In particular, holes 12*h* are illustrated as being arranged in three laterally spaced apart vertically oriented columns, with all of the holes 12*h* in each of the three columns being regularly vertically spaced apart from one another. Furthermore, FIG. 6A illustrates that the holes 12*h* in the two outermost columns (i.e., those proximate first side 12*e* and second side 12*f*) are aligned with one another in horizontally oriented rows. The holes 12*h* in the middle column (i.e., the column which extends along centerline "Y1") are offset with respect to the rows of holes 12*h* in the outer columns.

It will be understood that in other embodiments, the holes defined in shield 12 may be arranged in a different pattern from that illustrated in the attached figures. For example, the holes 12*h* may be arranged in two or more vertical columns parallel to centerline "Y1" but with the holes in the rows horizontally offset from one another. In yet other embodiments there may be no columns or rows of holes defined in shield. Instead, the holes 12*h* may be randomly scattered across shield 12 or may be arranged in diagonal rows or any other aesthetically pleasing pattern. For example, the holes may be arranged on shield 12 in a chevron pattern, a herringbone pattern, or a spiral pattern. Any desired arrangement or pattern of holes defined in shield 12 is contemplated to fall within the scope of the present disclosure.

It will further be understood that the number of holes 12*h* defined in shield 12 may be fewer than or more than the number of holes 12*h* shown on the attached figures. The number of holes 12*h* defined in shield 12 simply has to be sufficient to enable adequate engagement of liner 14 with shield 12, as will be discussed later herein.

The particular manner of forming holes 12*h* in shield 12 may vary from one embodiment to another. For example, the attached figures show "sharp" edges formed at the transition between outer surface 12*a* and an interior wall of shield 12 which bounds and defines each hole 12*h*. A similar sharp edge is provided where the interior wall intersects inner surface 12*b*. In other embodiments, the sharp edges at the intersection of outer surface 12*a*, inner surface 12*b* and the interior wall which bounds and defines each hole 12*h* may, instead, be gently rounded, chamfered, beveled or otherwise profiled. In one embodiment each hole 12*h* may be rimmed by a raised region provided on outer surface 12*a* and/or inner surface 12*b*.

Holes 12*h* provided in shield 12 help to improve the "breathability" of shield 12 by allowing air to flow therethrough. As will be described hereafter, liner 14 interlockingly and frictionally engages with shield 12 via the holes 12*h*. Liner 14 is capable of absorbing moisture and the holes 12*h* help a moist or damp liner 14 to dry out by allowing air to contact portions of the liner 14 and by allowing moisture to evaporate through holes 12*h*. The provision of holes 12*h* therefore helps to reduce the tendency of the assembly 10 to host bacteria and emit foul odors over time. The provision of holes 12*h* also tends to aid in prolonging the life of the liner 14 by enabling improved drying of the same.

Referring now to FIGS. 2 to 7B, liner 14 will be described in greater detail. Liner 14 is fabricated to be substantially complementary in shape to inner surface 12*b* of shield 12 and is configured to be selectively detachably engageable with shield 12 to form assembly 10. Liner 14 is effectively a pad element of assembly 10 which serves a number of purposes. These include but are not limited to making shield 12 more comfortable to wear against the player's skin, wicking moisture away from the player's skin, and providing cushioning and shock absorption. Liner 14 conforms to the contours of the player's shin during use. This conformational contact helps liner 14 to absorb/cushion impacts received on shield 12.

Referring particularly to FIGS. 4, 5, 7A and 7B, liner 14 comprises a body having an outer surface 14*a* and an inner surface 14*b* located opposite one another; a first end 14*c* and a second end 14*d* located opposite one another; and a first side 14*e* and a second side 14*f* located opposite one another. The body of liner 14 is generally arcuate in cross-section as can best be seen in FIG. 4. In particular, outer surface 14*a* of liner 14 is convexly arcuate in shape and is configured to conform at least partially to inner surface 12*b* of shield 12. Inner surface 14*b* of liner 14 is concavely arcuate in shape and is configured to conform, at least generally, to the shape of the player's shin 100*a* (FIG. 1).

The body of liner 14 has a centerline "Y2" (FIG. 3) which extends between a central region of first end 14*c* and a central region of second end 14*d*. As is evident from FIG. 7A, the body of liner 14 is symmetrical about centerline "Y2". The body of liner 14 also has a midline "X2" which extends between a central region of first side 14*e* and a central region of second side 14*f* and the body of liner 14 is symmetrical about midline "X2". FIG. 3 shows that when shield 12 and liner 14 are engaged with one another, centerlines "Y1" and "Y2" are aligned with one another and midlines "X1" and "X2" are aligned with one another, and the midlines are orthogonally-oriented relative to centerlines "Y1" and "Y2".

Figure 7A:
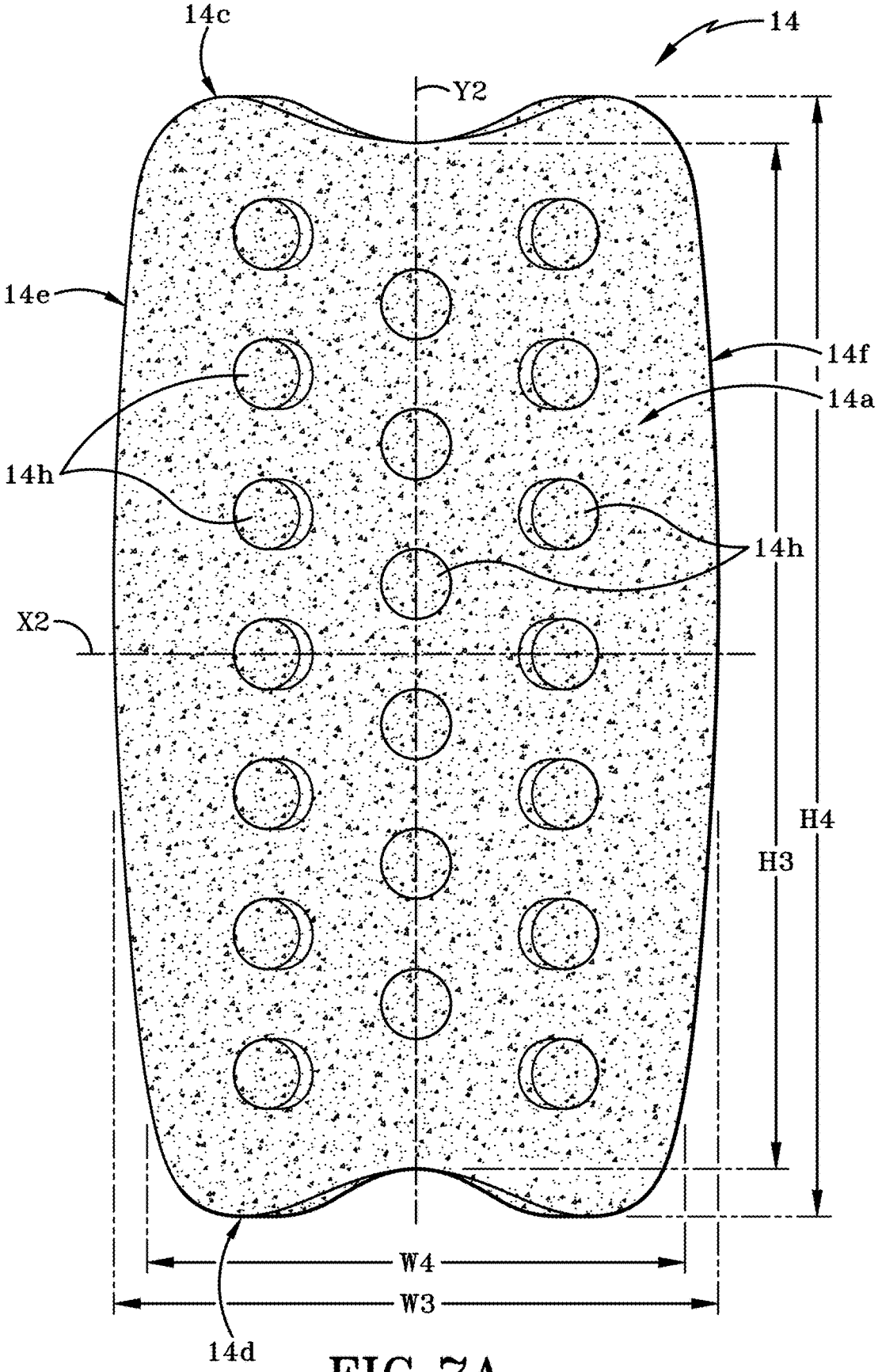
FIG. 7A is a front, top, right side perspective view of the liner of the shin sports guard assembly of FIG. 2 shown in isolation.
Figure 7B:
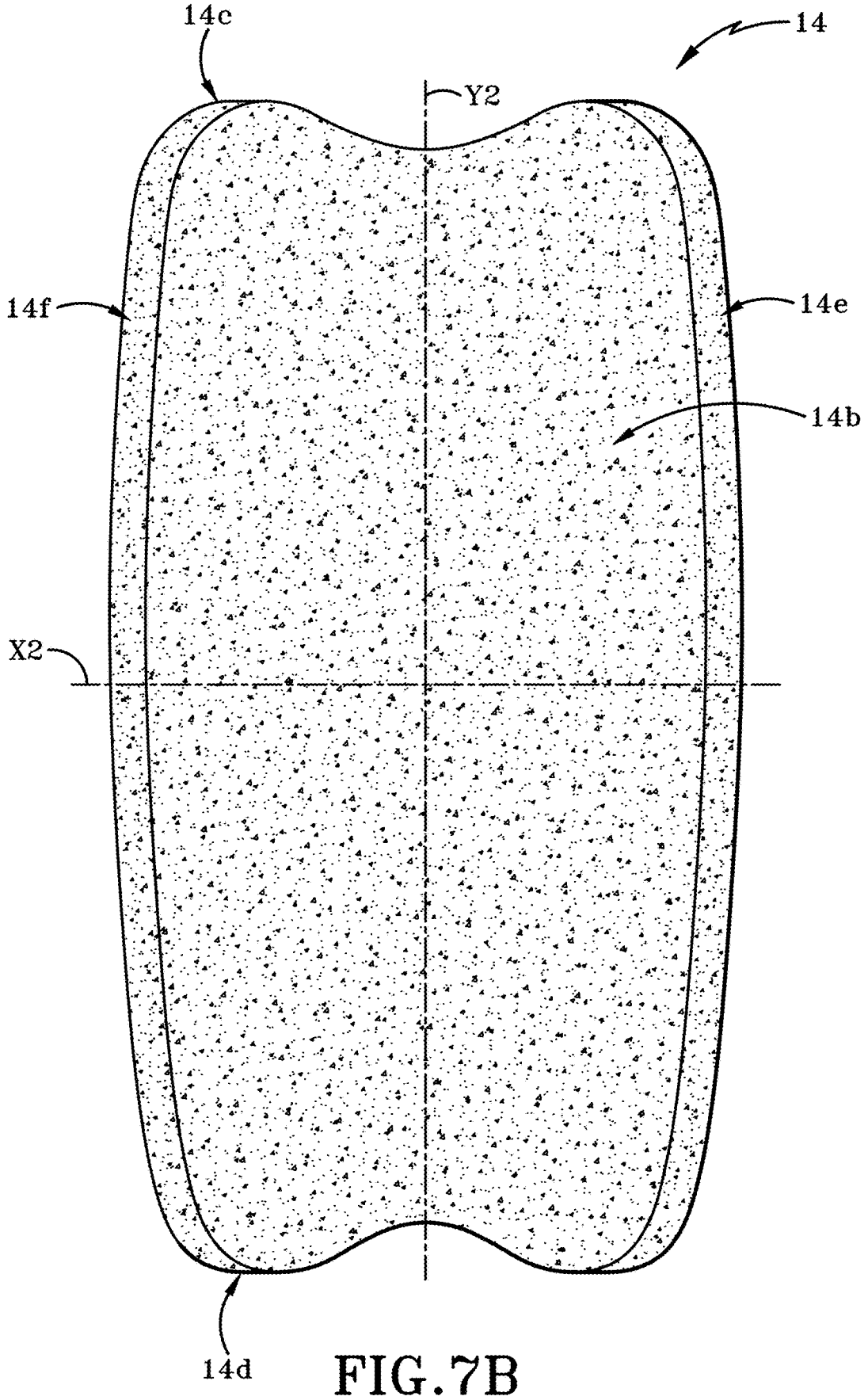
FIG. 7B is a rear elevation view of the liner shown in FIG. 7A.

It will also be noted from FIG. 7A that each of first end 14*c* and second end 14*d* of liner is U-shaped. In particular, first end 14*c* is U-shaped and the second end 14*d* is an inverted U-shape. The particular curvature of the U-shaped first end 14*c* and the inverted U-shaped second end 14*d* mirrors the contours of the U-shaped first end 12*c* and second end 12*d* of shield 12. As a result of this arrangement, the height "H3" (FIG. 7A) of liner 14, measured between first end 14*c* and second end 14*d* along centerline "Y2", is smaller than the height "H4" of liner 14 measured along a line parallel to centerline "Y2" and measuring the greatest distance between first end 14*c* and second end 14*d*. The height "H3" (FIG. 7A) of liner 14 approximates the maximum height "H2" (FIG. 6A) of shield 12. The U-shaped configuration of first end 14*c* and second end 14*d* of liner 14 is provided so that the assembly 10 has less of a tendency to interfere with the player's kneecap or ankle during use. It will be understood, however, that any other suitable configuration of first end 14*c* and second end 14*d* may be provided on liner 14 without departing from the scope of the present disclosure.

Referring to FIG. 4, the body of liner 14 is of a thickness "T2" measured between outer surface 14*a* and inner surface 14*b*. In one embodiment, the thickness "T2" is between 2 mm and 3 mm. The body of liner 14 is of a width "W3" measured along midline "X2" and between first side 14*e* and second side 14*f*. FIG. 7A shows that liner 14 is widest along midline "X2" and tapers gradually in width from midline "X2" moving in a direction towards first end 14*c*, and moving in an opposite direction from midline "X2" towards second end 14*d*. The body of liner 14 is of a smallest width "W4" proximate first end 14*c* and proximate second end 14*d*.

It should be noted that the height "H3" of liner 14 measured along centerline "Y2' is greater than the height "H1" of shield 12 measured along centerline "Y1", and the height "H4" of liner 14 is greater in size than the height "H2" of shield 12. Furthermore, the width "W3" of the body of liner 14 measured along midline "X2" is greater than the width "W1" of the body of shield 12 measured along midline "X1". The width "W4" of liner 14 is also greater than the width "W2" of shield 12. Because of the relative sizes of the body of liner 14 and the body of shield 12, when shield 12 and liner 14 are operatively engaged with one another as in FIG. 3, a region of liner 14 will extend outwardly beyond the exterior perimeter 12*g* of shield 12. This region of liner 14 which extends outwardly beyond perimeter 12*g* is indicated in FIG. 4 as peripheral region 14*g*. Since the liner 14 has a larger footprint than shield 12, the surface area of assembly 10 which contacts the player's shin 100*a* is effectively enlarged and therefore more protective than if liner 14 had the same footprint as shield 12. The peripheral region 14*g* of liner 14 serves another purpose, which will be described later herein.

As discussed above, in the embodiment of assembly 10 illustrated in the attached figures, the overall dimensions of the liner 14 exceed those of shield 12. It should be understood that in other embodiments the liner 14 and shield 12 may be of substantially equal dimensions. In yet other embodiments, the dimensions of liner 14 may be slightly smaller than those of shield 12 and so that a border region of shield 12 extends outwardly beyond a peripheral edge of the liner 14.

In accordance with an aspect of the present disclosure, liner 14 includes a plurality of protrusions 14*h* which extend outwardly from outer surface 14*a* of liner 14. Protrusions 14*h* extends for a distance "T3" (FIG. 4) outwardly beyond the outer surface 14*a* of liner 14. In one embodiment, each protrusion 14*h* extends outwardly from outer surface 14*a* of liner for a distance "T3" of about 3.5 mm to about 4 mm. The distance "T3" is greater than the thickness "T1" of shield 12. Consequently, when liner 14 and shield 12 are detachably engaged with one another, as shown in FIG. 4, the outermost surface 14*h*' of each protrusion 14*h* is located a short distance outwardly beyond outer surface 12*a* of shield 12.

Each protrusion 14*h* is configured to be complementary to one of the holes 12*h* defined in shield 12. Holes 12*h* as shown in the attached figures are circular in configuration. Protrusions 14*h* are therefore of a complementary circular configuration. Protrusions 14*h* are also sized so as to be receivable through holes 12*h*. In particular, the diameter of each protrusion 14*h* is substantially equal to the diameter of each hole 12*h*. In other instances, holes 12*h* in shield 12 may be of a first size and the protrusions 14*h* provided on liner 14 may be of a second size that is slightly greater than or equal to the first size of the holes 12*h*. In these instances, the protrusions 14*h* will be press fit into the associated holes 12*h* defined in shield 12. Protrusions 14*h* are arranged in an identical and complementary pattern to the pattern of the holes 12*h* defined in liner 12. No matter the pattern of the holes 12*h* defined in shield 12, the pattern of protrusions 14*h* will be complementary thereto, i.e., match the pattern of the holes 12*h*. In this way, each protrusion 14*h* is able to be received through an associated one of the holes 12*h* in the shield 12.

Because each protrusion 14*h* is configured to be received through one of the holes 12*h*, the diameter of each protrusion 14*h* is marginally smaller than the diameter of an associated hole 12*h* in shield 12. It will be understood that if shield 12 includes a variety of differently shaped and/or sized holes 12*h* defined therein, then identically shaped, sized, and located protrusions 14*h* are provided on liner 14. It will be understood that in some instances, depending on the shape, size or location of a hole 12*h* defined in shield 12, one or more protrusions 14*h* to be received through some of the holes 12*h* in shield 12. However, it should be understood that a sufficient number of protrusions 14*h* are provided to extend through associates holes 12*h* of shield 12 to keep shield 12 and liner 14 adequately engaged with one another during use.

The dimensions of protrusions 14*h* are such that allows shield 12 and liner 14 to be engaged with one another and disengaged from one another with relative ease. The dimensions of protrusions 14*h* are further such that when shield 12 and liner 14 are operatively engaged with one another the two components become a unitary component meaning the shield 12 and liner 14 move with one another as though they were a single component. Furthermore, the dimensions of protrusions 14*ha* are such that there will tend to be only marginal lateral, vertical and/or diagonal movement between shield 12 and liner 14.

Each protrusion 14*h* provided on liner 14 is illustrated as having a rounded or domed appearance when looking downwardly towards first end 14*c* of liner 14. One embodiment of the domed or rounded appearance of protrusions 14*h* can be seen in FIG. 4. It will be understood that the specific configuration of each protrusion 14*h* will be shaped and sized to the particular configuration of the holes 12*h* defined in shield 12. So, for example, if the interior wall which defines each hole 12*h* in shield 12 is configured to be gently convexly curved, each protrusion will have a complementary gently concave outer profile which matches the convex curve of the interior wall defining the associated hole 12*h*.

In accordance with an aspect of the present disclosure, liner 14 is fabricated from a suitable shock absorbing, cushioning material. One suitable material for fabrication of liner 14 is the energy absorbing and impact distributing material disclosed in U.S. Pat. No. 8,777,191 (Kligerman et al.). The Kligerman et al. patent is incorporated herein by reference. The material disclosed in the patent comprises a framework of interconnected units, where some of the units have a base and a protrusion or cone extending outwardly from the base along an axis. Connecting members or rods extend between the units having a base and protrusion. When the framework is impacted or compressed, the specially configured units tilt towards adjacent units and thereby help to absorb and cushion shocks and impacts. Suitable materials used to form the framework disclosed by Kligerman et al. include elastomers, plastics, organic and synthetic rubbers, and foams. A preferred material is an elastic closed cell ethylene vinyl acetate (EVA) foam. Preferably, the material used to fabricate liner 14 is a sustainable material and/or a recyclable material. EVA foam and organic and synthetic rubbers, for example, are recyclable materials which may be particularly suitable for fabricating liner 14.

Since the framework disclosed in the Kligerman et al. patent is relatively small, liner 14 may be molded with the framework in any orientation, i.e., with the bases of the units adjacent the inner surface 14*b* of the liner 14 and the protrusions of the units adjacent the outer surface 14*a* of the liner 14, or vice versa. Liner 14 may be molded utilizing only a single layer of the Kligerman et al. framework or with multiple layers thereof. Liner 14 may be molded to be of any overall thickness suitable for the specific use of assembly 10. In one embodiment, a suitable thickness of liner 14 molded from this framework may be from about 6 mm to about 12.7 mm (about ¼ inch to about ½ inch).

In another embodiment, liner 14 may be fabricated from a paper material, particularly, a recycled paper material and/or a paper material that may be recycled after use. The paper material may be 100% recycled newsprint or cardboard, for example, which is shredded mixed with water, and ultimately molded into the desired shape of the liner 14. Liner 14 may be fabricated using any suitable paper pulp molding process. In one embodiment, the liner 14 may be a Type 2 Molded Fiber Product.

Other possible options for fabrication of liner 14 is the use of a material including or made from algae foam. Preferably, this material will be partially or fully recyclable.

Liner 14 preferably is of a single, uniform construction from outer surface 14*a* through to inner surface 14*b* thereof. In other words, liner 14 preferably is fabricated from a single material, such as only EVA foam or organic rubber or recycled paper products. Fabricating liner 14 out of a single material makes it simpler, easier, and less expensive to manufacture the liner and to recycle the liner. If liner is fabricated using recycled paper products and it is needful to include a binder or adhesive to enable the liner 14 to be used for a longer period of time before being discarded, then only environmentally friendly, recyclable adhesives should be used in the fabrication of liner 14. Liner 14 preferably is not fabricated from multiple different materials such as paper products mixed with plastic products which are secured to one another via adhesives because not only is manufacture of liner made more complex, but recycling of the liner then becomes problematic and may not be possible.

If line 14 is fabricated from paper products, then a suitable non-toxic hydrophobic paper coating may be provided on at least a part of liner 14 to provide some sweat/water resistance thereto. For example, a suitable non-toxic hydrophobic paper coating may be applied at least to the inner surface 14*b* of liner 14. In some embodiments, the paper material may include reinforcing materials (which are all recyclable), such as string to help the molded liner stay strong and remain integrally intact.

It should be understood that while liner 14 is preferably fabricated from any suitable materials that may include sustainable recycled or recyclable materials and may be able to be fully or partially recycled after use, in other embodiments, non-recycled or non-recyclable materials may be utilized for fabrication of liner 14.

Figure 5:
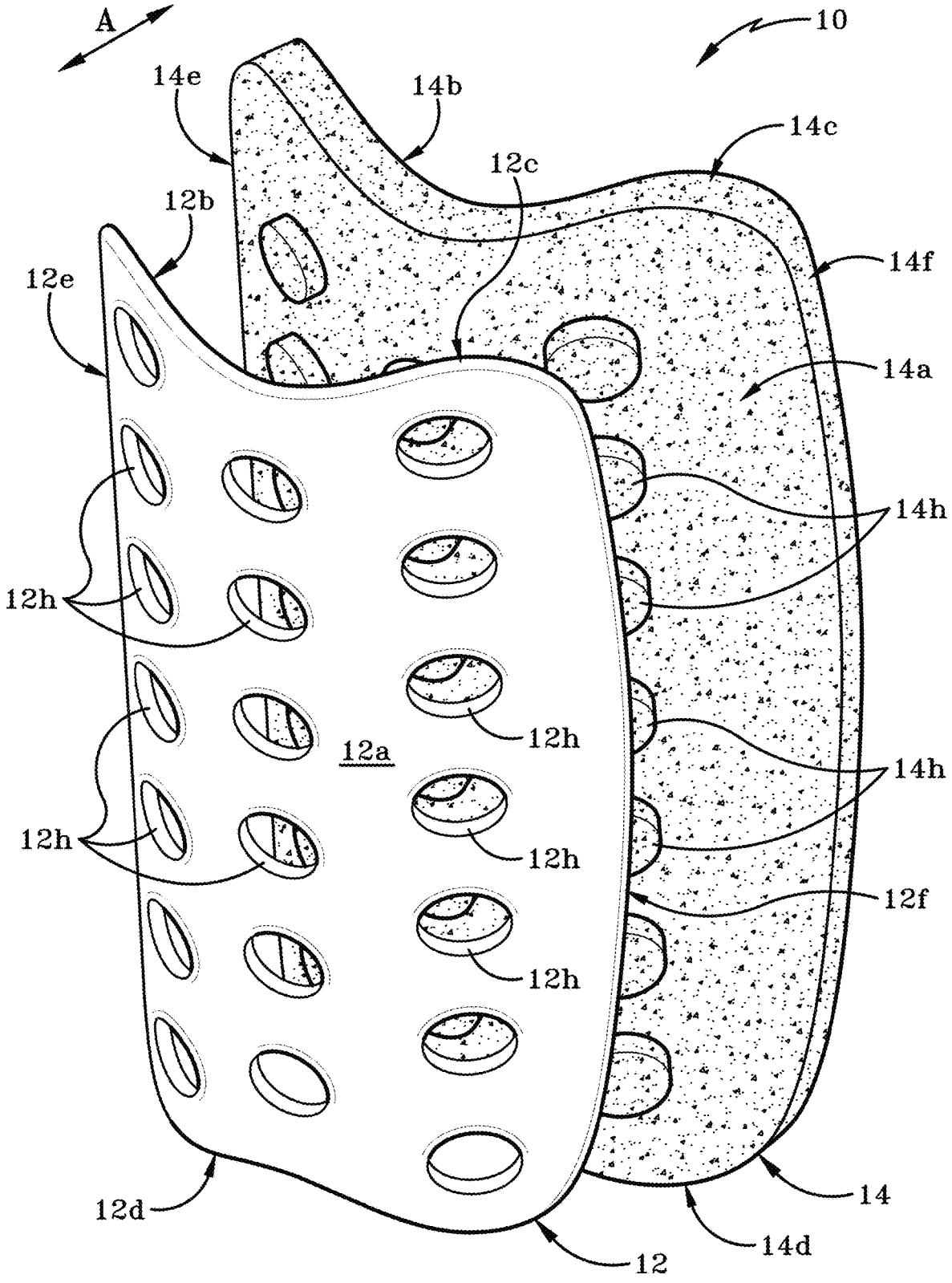
FIG. 5 is an exploded front, top, right side perspective view of the shin sports guard assembly in accordance with the present disclosure.

FIGS. 1 through 4 show assembly 10 in a condition where shield 12 and liner 14 are operatively engaged with one another and held together by interlocking engagement of protrusions 14*h* on liner 14 within holes 12*h* of shield 12, and by friction. FIG. 5 shows that the engagement between shield 12 and liner 14 is not a permanent engagement. Arrow "A" illustrates that shield 12 and liner 14 may be engaged with one another and later may be disengaged from one another. Shield 12 and liner 14 are engaged with one another when an athlete wishes to protect their shin. Shield 12 and liner 14 are disengaged from one another when liner 14 needs to be dried out or when liner 14 has become worn or damaged or is starting to smell unpleasant. Liner 14, if worn, damaged, or smelling unpleasant, is removed from its engagement with shield 12 and may then be either recycled or discarded. A replacement liner identical to liner 14 is then engaged with shield 12.

When a player wishes to use assembly 10 to protect their shins, he or she will take shield 12 and liner 14 and interlockingly engage them with one another. This engagement can be made by positioning liner 14 so that outer surface 14*a* thereof is placed in abutting contact with inner surface 12*b* of shield 12 or by positioning shield 12 so that its inner surface 12*b* is adjacent outer surface 14*a* of shield. When this is done, liner 14 is positioned such that each protrusion 14*h* on liner 14 is aligned with an associated one of the holes 12*h* defined in shield 12. The shield 12 and liner 14 are pushed inwardly towards one another so that protrusions 14*h* extend through holes 12*h* in shield 12 as shown in FIG. 4.

Once shield 12 and liner 14 are interlockingly engaged with one another the assembly 10 is then placed against the player's shin. The inner surface 14*b* of liner 14 is placed in abutting contact with the player's shin 100*a* and the player will pull their sock 102 (FIG. 1) over the shield 12. In other instances, the inner surface 14*b* of liner 14 may be placed against the player's shin 100*a*, the shield 12 may be positioned over liner 14 so that holes 12*h* in shield 12 aligned with protrusions 14*h* on liner 14. Shield 12 is pushed inwardly towards liner 14 until inner surface 12*b* of shield 12 abuts outer surface 14*a* of liner 14 and the protrusions 14*h* are received through holes 12*h*. The player will then pull their sock 102 over shield 12. In other words, shin sports guard assembly 10 may be assembled before placement on the player's shin 100*a* or while placing shin sports guard assembly 10 on the player's shin 100*a*.

When shield 12 and liner 14 are engaged with one another, protrusions 14*h* on liner 14 extend through holes 12*h* and an end region 14*h*' of each protrusion 14*h* extends outwardly beyond outer surface 12*a* of outer surface 12. This can be seen in FIG. 4. Protrusions 14*h* help to "mechanically" secure the liner 14 and shield 12 to one another. The protrusions 14*h* also help to ensure that there is little lateral or longitudinal relative movement between shield 12 and liner 14. Once shield 12 and liner 14 are operatively engaged with one another, the player will pull his or her sock (or sleeve) 102 upwardly over the outer surface 12*a* of shield 12. When this is done, the end regions 14*h*' of protrusions 14*h* will extend beyond outer surface 12*a* of shield 12 (FIG. 4). Because of this arrangement, protrusions 14*h* help to create some friction between assembly 10 and sock 102 (FIG. 1) worn over the assembly 10. The increased friction helps to keep the sock 102 and assembly 10 in place on the player's shin 100*a*. As indicated earlier herein, in other instances athletic tape such as PreWrap may be wrapped around the outer surface of shield 12 and the player's calf and shin 100*a* to hold assembly 10 in place.

Some of the advantages of the liner 14 of assembly 10 being formed from the material disclosed in the Kligerman et al. patent referred to earlier herein or to a recyclable paper material is that the liner is extremely lightweight but still retains strength during use, even while absorbing sweat. The lighter weight of assembly 10 makes it easier for the liner 14 and shield 12 to be retained in place on a player's skin and gives the player a greater sense of freedom of movement than is possible with some previously known shin guards.

Since the peripheral region 14*g* of liner 14 extends for a distance outwardly beyond exterior perimeter 12*g* of shield 12 (as illustrated in FIG. 4), liner 14 will tend to protect more of the athlete's shin 100*a* than would be the case if liner 14 was of the same height and width as shield 12. In one embodiment, the distance which the liner 14 extends outwardly beyond the exterior perimeter 12*g* of shield may be about 10 mm in size. Additionally, the condition of the peripheral region 14*g* of liner 14 provides real-time feedback to the player 100 as to the physical condition of liner 14. If the peripheral region 14*g* of liner 14 becomes damaged, it may signal to the player 100 that it is time to replace liner 14. This is particularly the case if the peripheral region 14*g* of the liner 14 wears away until it is substantially aligned with exterior perimeter 12*g* of shield 12.

It is contemplated that the assembly 10 in accordance with the present disclosure will be sold to the consumer as a kit. The kit will comprise one shield 12 and a plurality of liners 14 for use with shield 12. For example, the kit could include a pair of shields 12 (one for each leg) and ten liners 14. In particular, it is contemplated that shield 12 is fabricated from recycled post-consumer plastics that the liners 14 are fabricated from a recyclable material.

There are two main organizations which test protective athletic equipment, namely, NOCSAE which tests protective sport equipment in North America, and SATRA which tests protective sport equipment in Europe. Both organizations test a range of sport equipment and have labels which are placed on products which pass the organizations' rigorous testing. Most youth safety products require these labels in order for equipment to be used in competitive play.

The main forms of testing of shin guards includes using a conical leg anvil made from steel to secure the shin guard in place during impact testing. The anvil must have an adjustable mounting which will allow impacts to be delivered to any part of the shin guard. A spherical impactor is attached to a drop assembly. The drop assembly weighs no more than 2.43 pounds (1100 g). The performed direct impact tests focus on dropping the spherical impactor on the center of the shin guard as well as on the shin guard's edges in order to test the overall impact resistance of the shin guard. Along with the impact testing, these organizations also conduct stud impact testing which uses a plastic simulation stud to test the stud impact resistance of the shin guard. This type of testing is undertaken to ensure the shin guard retains strength under a smaller surface area impact. Still further, the organizations test whether or not there is sufficient area coverage provided by the shin guard to sufficiently protect a user's shin.

The assembly 10 in accordance with the present disclosure was subjected to unofficial testing based on the testing requirements of NOCSAE and SATRA. The assembly 10 which was tested comprised a shield 12 fabricated from recycled post-consumer plastics and a liner 14 fabricated from paper products. The assembly 10 easily passed all tests.

The assembly 10 in accordance with the present disclosure was also tested in real life through being worn during play of actual soccer games. The liner 14 (made from paper products) was found to perform well for at least five sessions of 90-120 minutes of play. Liner 14 is able to be reused a few times and may then be recycled or discarded. Liner 14 is not contemplated to be a single use component which is thrown away after a single use. This would only occur if the liner 14 completely broke down in a single game and needed to be discarded for that reason. Based on this, a kit including a pair of shields 12 and ten liners 14 would be capable of lasting the soccer player about fifty sessions, i.e., the equivalent of one entire soccer season. The shields 12 would be able to be reused in subsequent soccer seasons and the consumer will simply purchase a replacement set of liners 14 for the subsequent soccer seasons.

If the liners 14 are fabricated entirely from a recyclable rubber, or a recyclable EVA or a recyclable paper product, when a liner 14 is deemed to be no longer usable, either because the liner is starting to break down or smell, that liner 14 can simply be put into the recycling stream and can be recycled. Alternatively, the liner 14 may be thrown into the garbage.

It is further contemplated that the shield 12 and liner 14 will be fabricated in the four standard sizes in which currently available shin guards are manufactured and sold. Because the shield 12 and the liner 14 are not permanently physically bonded to one another (such as through an adhesive or fasteners), the shield 12 can be reused with replacement liners 14. Additionally, the shield 12 could be utilized in a youth sports program where players could swap their shields for larger size shields as the players grow. The combination of reusable and swappable shields along with fully recyclable liners will substantially reduce the number of shin guards being thrown annually into landfills.

Furthermore, because the shin sports guard assembly of the present disclosure is only fabricated from two materials (post-consumer plastics and recyclable products) and because these two materials are fully recyclable, the production and use of shin sports guard assembly 10 will leave a minimal impact on the environment. In fact, because shield 12 of assembly 10 is to be fabricated from recycled plastics and in some instances recyclable paper, assembly 10 may actually contribute to providing an end market for certain products placed in the recycling stream.

Shin sports guard assembly 10 has been disclosed herein as comprising a shield 12 which defines a plurality of holes 12*h* therein and a liner 14 having a plurality of protrusions 14*h* thereon, wherein the protrusions 14*h* of liner 14 are received through the holes 12*h* of shield 12. In other embodiments, shield 12 may also include indentations in inner surface 12*b* that receive protrusions extending outwardly from liner 14. The purpose of the shield 12 is protection from impact and the purpose of the liner 14 is comfort against the skin. Protrusions 14*h* provide cushioning as the protrusions are compressed on contact (when shield 12 takes an impact blow). The protrusions 14*h* then expand again after the contact blow to shield 12.

It will be understood that in other embodiments, the liner may be the component which defines a plurality of holes or indentations or recesses therein and the shield may then include a plurality of protrusions which extend into holes, recesses or indentations formed in the liner. The cooperating protrusions and holes, recesses or indentations retain the shield and liner in interlocking and frictional engagement with one another. In yet other embodiments each of the shield and the liner may define a plurality of holes therein and each may also provide a plurality of protrusions thereon. The location of the holes in the shield will be complementary to the protrusions provided on the liner and the location of the protrusions on the shield will be complementary to the holes defined in the liner. When the shield and the liner are operably engaged with one other, each protrusion, whether provided on shield or liner, will be received into an associated complementary hole in the other of the shield and liner. The difference between protrusions provided on liner 14 and protrusions provided on shield 12 is that protrusions 14*h* on liner 14 preferably are long enough to extend through the entire thickness of shield 12 and for a distance outwardly beyond outer surface 12*a* thereof. Any protrusions provided on shield 12 will not extend outwardly beyond inner surface 14*b* of liner 14 when shield 12 and liner 14 are engaged as this would bring those hard, rigid shield protrusions into direct contact with the person's shin. In such an alternative embodiment, it would be desirable if any holes in liner 14 were not through-holes extending between outer surface 14*a* and inner surface 14*b* of liner 14. Instead, the holes in the liner would be indentations or recesses which terminate a distance inwardly from inner surface 14*b* of liner 14. Protrusions extending from the inner surface 12*b* of shield 12 would thereby be separated from the user's shin by a certain thickness of the liner 14 and would thereby be less prone to cause injury to the player if the shin guard experiences blunt force impact from a fall or a kick or a strike from a bat or ball. Shield 12 is furthermore fabricated from a material that can withstand stud impact from contact from athletic footwear. (Obviously, if assembly 10 is used in arenas other than sporting events, the material used to fabricate shield 12 is capable of withstanding impacts from equipment used in the performance of a job or from a fall experienced in a work setting.)

As indicated earlier herein, assembly 10 as described herein is configured to be a type of shin guard known as a "slip in" shin guard, i.e., a shin guard which is retained against a user's shin via a sock, compression sleeve, or Pre-wrap. In other words, shin sports guard assembly 10 is free of straps which might be utilized to hold the assembly in contact with a part of a person's body. In other embodiments, however, assembly 10 may be provided with straps which may be utilized to hold assembly 10 against a part of the user's body. In other embodiments, assembly 10 may further include a means to physically lock shield 12 and liner 14 to one another, such as some type of fastener mechanism.

While shin sports guard assembly 10 as disclosed herein is useful for protecting a shin 100*a* of an athlete 100 or of a worker from injury, it will be understood that the principles of manufacturing and utilizing shin sports guard assembly 10 can be embodied in other guard assemblies used to protect other parts of the human body. For example, the shield and liner may be configured in a shape and in such dimensions as to be useful to protect a person's knees, ankles, feet, elbows, or forearms against injury. The term "shin sports guard assembly" as used herein should therefore be widely interpreted to represent any protective device comprising a shield configured to conform to a part of the human body and a liner configured to be interposed between the shield and the person's body. The shield 12 is fabricated from any suitable material capable of withstanding impact.

The liner 14 is fabricated from any suitable material capable of absorbing shocks, of wicking moisture away from the skin, and seating the shield comfortably adjacent the body. The liner 14 is detachably engaged with the shield 12. The liner 14 is retained in separable engagement with the shield 12 utilizing an interference fit between protrusions on the liner and holes on the shield (or vice versa). The shield 12 and liner 14 preferably may be fully or partially recycled after use or may be discarded. After disengagement of liner 14 from shield 12, a new, similarly configured and preferably sustainable and recyclable replacement liner may be engaged with the shield. After multiple uses, (preferably at least one sports season or longer), shield 12 may be fully or partially recycled, or may be discarded.

Figure 8:
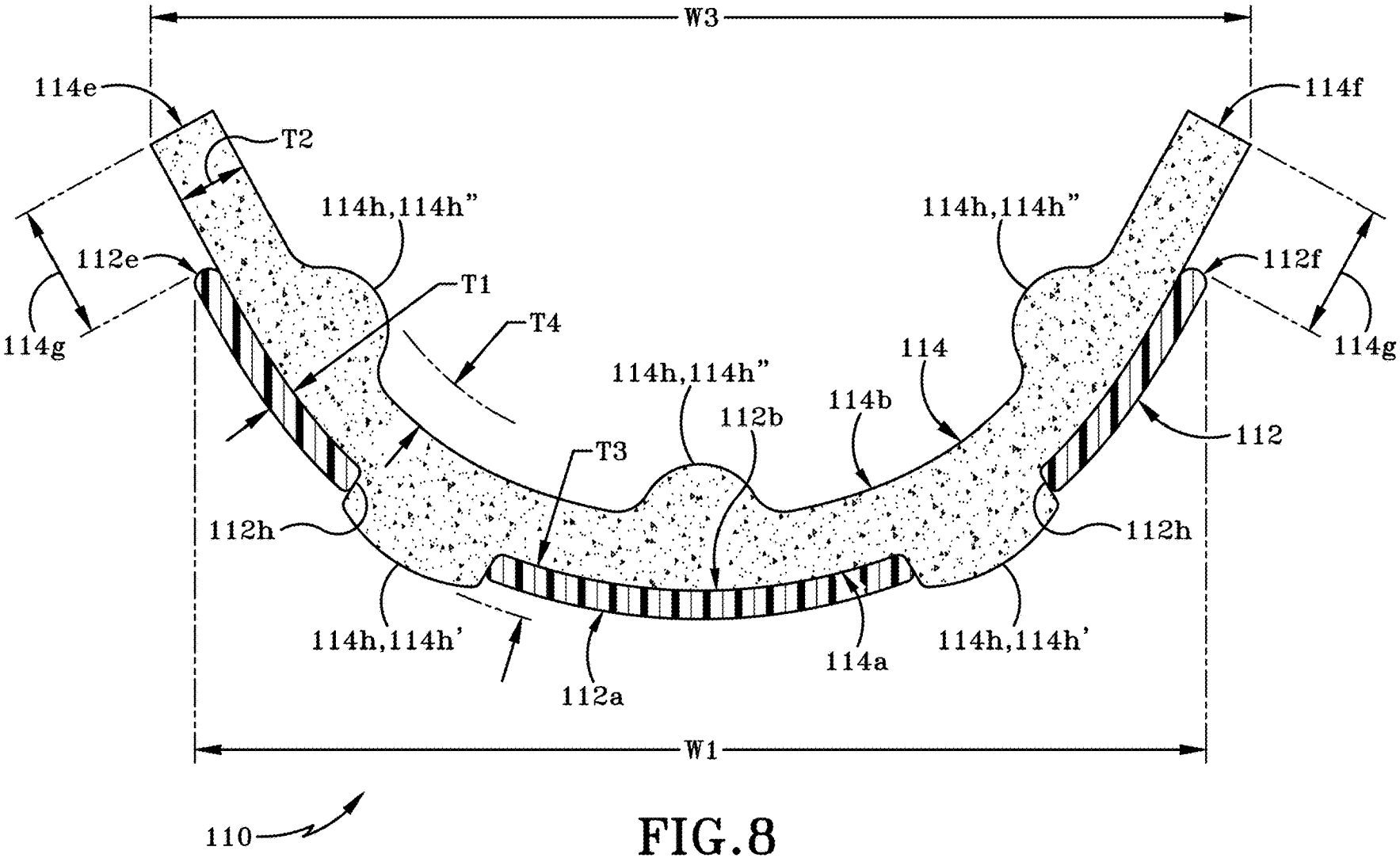
FIG. 8 is a cross-section of an alternative second embodiment of a shin sports guard assembly in accordance with the present disclosure which is similar to the cross-section shown in FIG. 4.

Referring now to FIG. 8 there is shown a cross-section of an alternative second embodiment of a shin guard assembly in accordance with the present disclosure, generally indicated at 110. The shin guard assembly 110 is identical in substantially all aspects to shin guard assembly 10 except for the features which will be described hereafter in greater detail. Shin guard assembly 110 (also referred to herein as "assembly 110") comprises a shield 112 and a liner 114. Shield 112 is identical to shield 12 and includes an outer surface 112*a*, an inner surface 112*b*, a first end and a second end (not shown in FIG. 8 but similar to first end 12*c* and second end 12*d* of shield 12), a first side 112*e* and a second side 112*f*. Shield 112 defines a plurality of holes 112*h* therein which extend between outer surface 112*a* and inner surface 112*b*. Shield 112 is of a thickness "T1" measured between outer surface 112*a* and inner surface 112*b*. In one embodiment, the thickness "T1" may be between 1.5 mm and 2 mm.

Liner 114 is substantially similar to liner 14 except for the features which will be pointed out hereafter. Liner 114 has an outer surface 114*a*, an inner surface 114*b*, a first end and a second end (not shown in FIG. 8 but similar to first end 14*c* and second end 14*d* of liner 14), a first side 114*e*, and a second side 114*f*. A peripheral region 114*g* of liner 114 extends outwardly beyond the perimeter 112*g* of shield. A plurality of protrusions 114*h* extend outwardly from outer surface 114*a* in an arrangement which is complementary to the arrangement of the holes 112*h* defined in shield 112. Liner 114 is of a thickness "T2" measured between outer surface 114*a* and inner surface 114*b*. In one embodiment, the thickness "T2" is of about 2 mm to 3 mm. Protrusions 114*h* extend for a distance "T3" from outer surface 114*a* and therefore for a distance beyond the outer surface 112*a* of shield 112. In one embodiment, each protrusion 114*h* extends outwardly from outer surface 114*a* of liner for a distance "T3" of about 3.5 mm to 4 mm and therefore beyond the outer surface 112*a* of shield 112 for about 2 mm. Protrusions have an outer region 114*h*' which will contact the interior surface of a sock or sleeve 102 and frictionally engage the same.

Liner 114 differs from liner 14 in that a plurality of protrusions 114*j* extend from inner surface 114*b* of liner 114 in a direction opposite to the plurality of protrusions 114*h*. Protrusions 114*j* extend for a distance "T4" from inner surface 114*b* and terminate in an outer surface 114*j*'. As can be seen from FIG. 8, the outer surface 114*j*' of each protrusion 114*j* is generally domed, rounded, or hemispherical in configuration. In one embodiment, each protrusion 114*j* extends from inner surface 114*b* of liner 114 for a distance "T4" of about 3.5 mm to 4 mm.

It will be understood that, in other embodiments, all of the protrusions 114*h* will also be domed, rounded, or hemispherical in configuration in a manner similar to how protrusions 114*j* are illustrated.

In one embodiment, protrusions 114*j* are arranged in rows similar to the rows of protrusions 114*h* although any other desired arrangement of protrusions 114*j* may be utilized without departing from the scope of the present disclosure. As illustrated in FIG. 8, the rows of protrusions 114*j* alternate with the rows of protrusions 114*h*. In view of the location of protrusions 114*j*, the outer surface 114*j*' of each protrusion 114*j* will contact the shin 100*a* of the player 100. In the event of a ball strike or kick to the shin, the shield 112 will protect the player's shin 100*a* against impact injury and the protrusions 114*j*, in particular, will compress slightly, helping to absorb some of the impact force in addition to the shock absorption already offered by the material of liner 112. Once the impact force to shin guard assembly 110 has ceased, protrusions 114*j* will tend to return to an uncompressed state.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to one another, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc.

Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A guard assembly for protecting a part of a person's body comprising: a shield; a liner interlockingly engaged with the shield; wherein the liner comprises: an outer surface and an inner surface opposite one another; a first end and a second end opposite one another; a first side and a second side opposite one another; wherein the liner is arcuate in cross section; wherein the inner surface of the liner is configured to abuttingly contact the part of the person's body; wherein a peripheral region of the liner extends for a distance outwardly beyond an exterior perimeter of the shield; and wherein the liner is selectively detachably engaged with the shield to allow for the liner to be disengaged from the shield and replaced with a new liner.

2. The guard assembly according to claim 1, wherein the liner is fabricated from one of a recyclable material and a sustainable material.

3. The guard assembly according to claim 1, further comprising:

a plurality of holes defined in one of the shield and the liner;

a plurality of protrusions defined in the other of the shield and the liner; and wherein each protrusion of the plurality of protrusions is receivable through an associated hole of the plurality of holes.

4. The guard assembly according to claim 3, wherein the plurality of protrusions received through the plurality of holes interlockingly engage the shield and liner with one another.

5. The guard assembly according to claim 3, wherein one or more protrusions of the plurality of protrusions is of a size smaller than a size of one or more holes of the plurality of holes.

6. The guard assembly according to claim 3, wherein the plurality of holes are defined in the shield and each hole of the plurality of holes extends from an outer surface of the shield to an inner surface of the shield.

7. The guard assembly according to claim 6, wherein the liner contacts the inner surface of the shield and the plurality of protrusions extend through the plurality of holes of the shield; and wherein the plurality of protrusions project for a distance beyond the outer surface of the shield.

8. The guard assembly according to claim 1, wherein the shield is fabricated from recycled post-consumer plastics.

9. The guard assembly according to claim 1, wherein the shield is fabricated from a rigid material and the liner is fabricated from a shock absorbing material.

10. The guard assembly according to claim 1, wherein the guard assembly is a sports guard assembly, the shield is reusable for one or more sports seasons and the liner is replaceable after less than one sports season.

11. The guard assembly according to claim 1, wherein the peripheral region of the liner is free from engagement with the exterior perimeter of the shield.

12. A guard assembly for protecting a part of a person's body, said guard assembly comprising:

a shield formed from a material capable of withstanding blunt force impact and/or stud impact;

at least one hole defined in the shield, wherein the at least one hole extends from an outer surface to an inner surface of the shield;

a liner formed from a shock absorbing material;

at least one protrusion extending outwardly from an outer surface of the liner;

wherein the at least one protrusion of the liner is received through the at least one hole in the shield when the outer surface of the liner is brought into abutting contact with the inner surface of the shield;

wherein when the at least one protrusion of the liner is received through the at least one hole in the shield, the at least one protrusion extends outwardly beyond the outer surface of the shield; and wherein engagement of the at least one protrusion in the at least one hole retains the liner and shield in engagement with one another.

13. The guard assembly according to claim 12, wherein the at least one protrusion is of a size relative to the at least one hole that when the at least one protrusion is received in the at least one hole, movement between the shield and the liner relative to one another is prevented or limited.

14. The guard assembly according to claim 12, wherein the liner is fabricated from one of a sustainable material and a recyclable material.

15. The guard assembly according to claim 12, wherein the shield is fabricated from recycled post-consumer plastics.

16. A sports guard assembly kit comprising the guard assembly according to claim 12, wherein the guard assembly comprises a single shield and a plurality of liners that are interchangeably engageable with the single shield.

17. The guard assembly according to claim 12, wherein the at least one protrusion are configured to frictionally engage an inside surface of a sock, sleeve, or athletic tape worn over the shield to inhibit movement of the guard assembly under impact loads.

* * * * *